US006238067B1

(12) United States Patent
Hirsch

(10) Patent No.: US 6,238,067 B1
(45) Date of Patent: May 29, 2001

(54) ILLUMINATED BALLOON APPARATUS

(76) Inventor: Eric Hirsch, 1376 Haxel St., NW., Palm Bay, FL (US) 32907

( * ) Notice: Subject to any disclaimer, the term of this patent is extended or adjusted under 35 U.S.C. 154(b) by 0 days.

(21) Appl. No.: 09/313,844

(22) Filed: May 17, 1999

(51) Int. Cl.[7] ..... F21V 33/00

(52) U.S. Cl. ..... 362/352; 362/96; 362/253; 362/806; 362/399; 362/276; 362/231; 446/220; 446/222; 446/224

(58) Field of Search ..... 362/352, 363, 362/96, 253, 806, 276, 802, 249, 800, 230, 231, 399; 446/220, 224, 485

(56) References Cited

U.S. PATENT DOCUMENTS

| | | | | |
|---|---|---|---|---|
| 2,646,019 | | 7/1953 | Chetlan . | |
| 3,536,906 | | 10/1970 | Bloom . | |
| 3,592,157 | | 7/1971 | Schwartz . | |
| 3,797,492 | * | 3/1974 | Place | 128/260 |
| 3,839,631 | * | 10/1974 | Goddard | 362/363 |
| 4,736,281 | | 4/1988 | Neumeier . | |
| 4,794,498 | * | 12/1988 | Neumeier | 362/186 |
| 4,997,403 | | 3/1991 | Akman . | |
| 5,117,344 | | 5/1992 | Perez . | |
| 5,119,281 | | 6/1992 | Akman . | |
| 5,183,329 | | 2/1993 | Chen . | |
| 5,327,845 | | 7/1994 | Cook . | |
| 5,444,607 | * | 8/1995 | Dreyfuss | 362/352 |
| 5,499,941 | | 3/1996 | Penjuke, Sr. . | |
| 5,782,668 | | 7/1998 | Chabert . | |
| 5,795,211 | | 8/1998 | Carignan et al. . | |
| 5,807,157 | | 9/1998 | Penjuke . | |
| 5,857,760 | | 1/1999 | Pelton . | |
| 6,012,826 | * | 1/2000 | Chabert | 362/363 |
| 6,106,135 | * | 8/2000 | Zingale et al. | 362/806 |

* cited by examiner

*Primary Examiner*—Thomas M. Sember
(74) *Attorney, Agent, or Firm*—David G. Maire; Robert L. Wolter; Holland & Knight LLP

(57) ABSTRACT

A balloon lighting device having both polar and equatorial supports for the light source inside the balloon. Equatorial caps provide connections for light source support and for tethering of the balloon. The light source may include an array of LED's and may be connected to a dimmer to provide a variety of light intensities and wavelengths. A shroud supported from a top cap may be used to further define the illumination effect. The dimmer may function as an anchor for flexible positioning of the light or it may be hung from the balloon to conserve lay-down space. A plurality of balloon lighting devices may be controlled from a single console having DMX control capability.

47 Claims, 1 Drawing Sheet

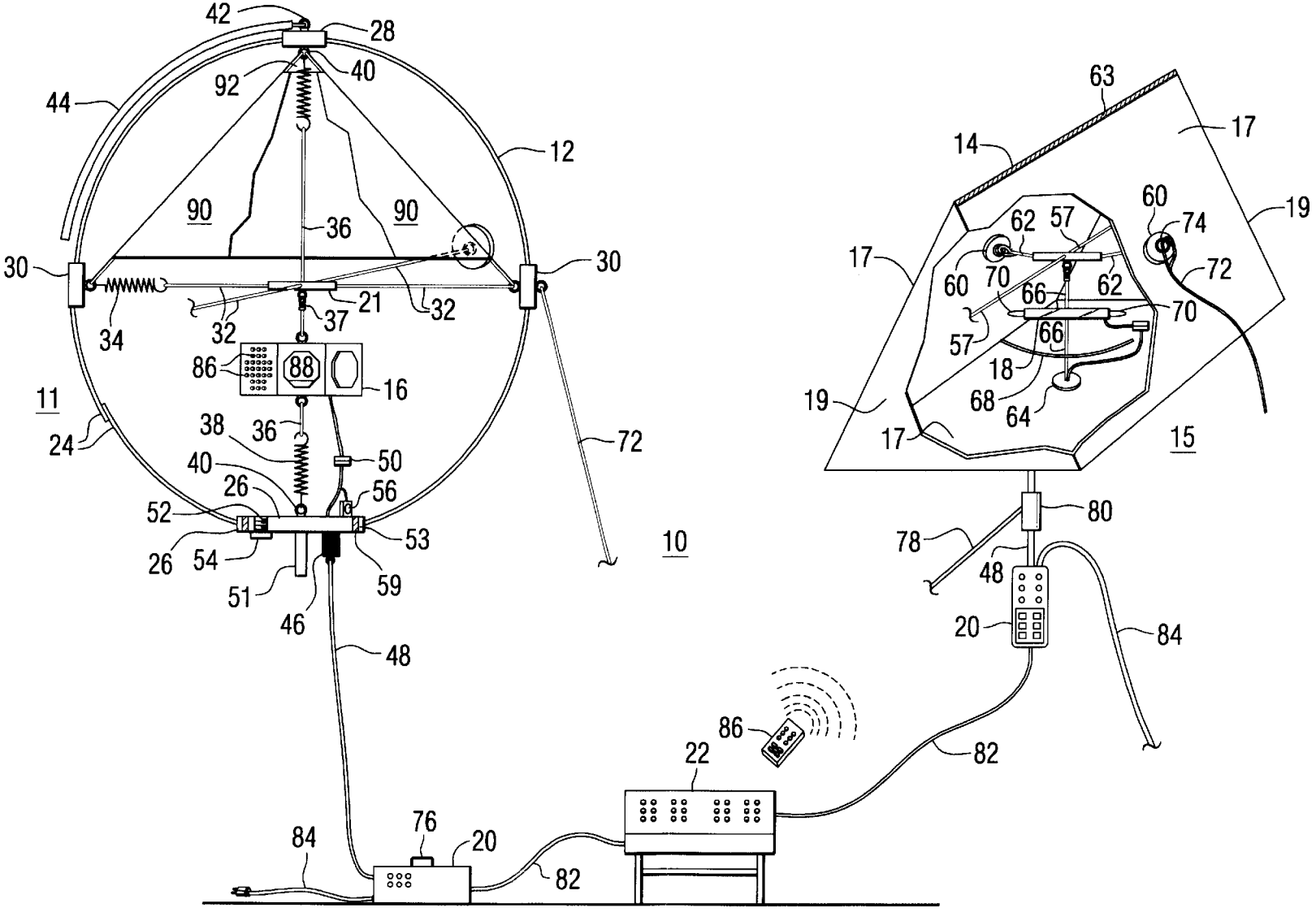
10
11
12
14
15
16
17
18
19
20
21
22
24
26
28
30
32
34
36
37
38
40
42
44
46
48
50
51
52
53
54
56
57
59
60
62
63
64
66
68
70
72
74
76
78
80
82
84
86
88
90
92

ILLUMINATED BALLOON APPARATUS

FIELD OF THE INVENTION

This invention relates generally to the field of illuminated balloons, and more particularly to a balloon lighting device having an improved light source and an improved structure for supporting the light source inside the balloon.

BACKGROUND OF THE INVENTION

It is known to illuminate a balloon by placing a light source inside the balloon. An illuminated balloon may be used as a decorative item or as a light source for area illumination. U.S. Pat. No. 5,499,941 issued to Penjuke on Mar. 19, 1996, illustrates a small, inflated balloon with a battery operated light source inserted therein. Such balloons are commonly used as novelty items at fairs and circuses. U.S. Pat. No. 5,807,157 issued to the same inventor on Sep. 15, 1998, illustrates a similar device that utilizes a light emitting diode as the light source. The light source for these devices is supported by a tube over which the neck of a balloon is stretched.

U.S. Pat. No. 5,857,760 issued to Pelton on Jan. 12, 1999, illustrates a larger balloon designed to function as an area illumination device. Each of the above-cited patents is incorporated by reference herein. The balloon 10 of Pelton surrounds a fiber optic light emitter 32 that is mounted on a support ring 18. The support ring 18 is attached to the balloon by two internal support cables 20. Theses cables and the fiber optic cable 16 provide support for the light emitter 32 in only two dimensions, i.e. in the plane of the paper of the patent drawing. The light emitter 32 is free to swing in a direction perpendicular to this plane. The practicality of the use of prior art balloon lighting devices is limited due to the potential for damage to the light source resulting from violent movement of the light source within the balloon during high wind situations. The inadequacy of such a support system is aggravated if the balloon has a small lead or is not entirely filled with gas, since slack in the cables 20 results in additional swinging motion of the light emitter 32. Balloons having incandescent bulbs as the light source have been known to fail due to the hot bulbs swinging against the side of the balloon, thereby burning a hole in the balloon fabric. The stability of prior art balloons is also limited due to the inadequacy of the supporting devices connecting the balloon to the ground, such as the security cables 56 of the Pelton device. Because prior art devices are susceptible to uncontrolled movement and structural failure in windy situations, the application of these devices for outdoor applications has been limited.

Prior art balloon lighting devices used for area illumination applications have also been limited to providing white light only. Fiber optic devices and light emitting diodes have been applied only for novelty applications due to the limited light output of such devices. The wattage of colored incandescent bulbs is limited due to the durability of the colored layer applied to the bulb to obtain the colored light. High wattage lamps are available only with clear glass, and therefore prior art balloon lighting devices have been limited to application requiring white light. Furthermore, prior art balloon lighting devices have been limited to supplying a predetermined intensity of light based upon the selection of the wattage of the bulbs installed within the balloon. An increase or decrease in the desired intensity is accomplished by replacing the bulbs within the balloon. For many applications, such as for lighting of movie sets, it is desirable to have a light source that can be quickly varied in intensity and in the direction of the light beam. The application of balloon lighting devices for sophisticated applications, such as movie set lighting, has been limited by the constraints of prior art designs.

SUMMARY OF THE INVENTION

In light of the limitations of the prior art devices discussed above, it is an object of this invention to provide a balloon lighting device that has an improved support system for the light source within the balloon. It is a further object of this invention to provide an improved structure for tethering a balloon lighting device to the ground. It is a further object of this invention to provide a balloon lighting device that can provide a varying intensity of light. It is also an object of this invention to provide a balloon lighting device capable of providing light of various wavelengths. It is a further object of this invention to provide a balloon lighting device that has the improved flexibility for placement, intensity, and direction of the supplied light.

These and other objects of this invention are satisfied by a balloon lighting device including a balloon; a light source disposed inside the balloon at a predetermined position relative to the balloon; and a means for resisting movement of the light source in any direction away from the predetermined position. The means for resisting movement further may further include a polar attachment connecting the light source to opposed poles of the balloon; and an equatorial attachment connecting the light source to an equator of the balloon. The objects of the invention are further satisfied by a balloon lighting device including a balloon; an array of light emitting diodes disposed within the balloon; a cap joined to the balloon; an electrical connection having a first end attached to the array, a length passing through the cap, and a second end extending away from the balloon; and a dimmer connected to the second end and operable to control light emitted from the array.

BRIEF DESCRIPTION OF THE FIGURE

The FIGURE illustrates balloon lighting system in accordance with the subject invention.

DETAILED DESCRIPTION OF THE INVENTION

The FIGURE illustrates a lighting system 10 having two balloon lighting devices 11, 15. Balloon 12 is generally circular in cross section while balloon 14 is generally triangular in cross section. The balloons 12, 14 each enclose a light source 16, 18 that is connected to a dimmer 20 controlled from a lighting control console 22.

Balloon 12 is formed from rip stop nylon as is commonly used in the parachute industry and is available from Aerostar International Inc, Souix Falls, S. Dak. The nylon is preferably coated with a polyurethane coating, and it is joined along its respective edge portions 24 by a heat seal process. Alternatively, sections of balloon 14 are illustrated as being joined by a helium-tight zipper 63. The neck of balloon 12 is joined to a bottom cap 26 as will be described more fully below. Top cap 28 and a plurality of equatorial caps 30 are also joined to the balloon 12. In order to provide three dimensional support for light source 16, there are preferably three or four equatorial caps 30 spaced apart along the equator of the balloon 12. Caps 30 function as an equatorial attachment connecting the light source 16 to the balloon 12 at its equator by means of cables 32. Cables 32 are preferably aircraft cable as is known in the art. A spring 34 may be connected between the cap 30 and the light source 16 in order to provide some flexibility in the support arrangement. Light source 16 is also supported from top cap 28 and bottom cap 26 by cables 36. A spring 38 or other means of providing flexibility in the support arrangement may be provided between the bottom cap 26 and the light source 16. Top cap 28, cables 36, spring 38, and bottom cap 26 constitute a polar attachment supporting light source 16 within balloon 12. Similarly caps 30, cables 32, and spring 34 form an equatorial attachment supporting the light source 16 within the balloon 12. Acting together, the polar attachment and the equatorial attachment provide three dimensional support for light source 16 within the interior of the balloon 12, thereby resisting movement of the light source 16 in any direction from its predetermined position within the balloon 12. Note that the equatorial attachment is equally effective in supporting light source 16 whether it contains two or three points of attachment to the balloon 12. However, if only two points of attachment are used, the support for the light source would be effective in two dimensions only, thereby allowing the light source 16 to swing freely in a direction perpendicular to that plane of support.

Spring 38 is advantageously located along the polar attachment at a location below light source 16. Prior art devices have provided a spring connection between a light source and a top cap of a balloon. Since a spring is a common failure point for such light support systems, the failure of the spring in a prior art device would result in the collapse of the light source onto the bottom of the balloon. In the balloon lighting device 11 of this invention, spring 38 is located below light source 16. In the event that spring 38 were to fail, there would be no catastrophic failure of the lighting device 11 since light source 16 would remain supported above the bottom of the balloon.

Top poll cap 28 includes an interior connector 40 for attachment of wire 36. Top cap 28 also includes an exterior connector 42 located outside of the balloon 12. A shroud 44 may be connected to exterior connector 42. The shroud 44 is operable to cover at least a portion of an exterior surface of the balloon 12. If the shroud 44 is made of an opaque material, the placement of the shroud 44 is effective for directing the light produced by the balloon lighting device 11. For example, shroud 44 may be formed to cover at least the top half of the balloon 12 in order to direct all of the light from the balloon downward. Shroud 44 may also be formed of a translucent material of various colors for the purpose of changing the wave length of the light produced by balloon lighting device 11. Shroud 44 is particularly useful for lighting on movie sets where the intensity and direction of the light produced must be precisely controlled.

Bottom pole cap 26 provides several functions for balloon lighting device 11. Bottom cap 26 includes an interior connector 40 for attachment to light source 16. Bottom cap 26 also includes an exterior connector, which is illustrated in the FIGURE as a strain relief device 46. Strain relief device 46 serves to distribute the loading carried between cable 48 and bottom cap 26. In the embodiment illustrated in the FIGURE, cable 48 includes electrical wiring connections to light source 16. Cable 48 extends through bottom cap 26 and is joined to light source 16 by plug connector 50. Cap 26 may also be used to mount a spud 51. Spud 51 is formed as a pipe that is threaded into cap 26. Spud 51 is used to receive a pole for supporting the balloon 12 in heavier-than-air applications.

Cap 26 also includes a means for filling the balloon with a gas. Quick fill swirl connection 52 is formed as a large hole through bottom cap 26 through which air or a lighter-than-air gas is introduced into the balloon. Once the balloon is filled, a seal such as screw cap 54 is installed over the quick fill swirl connection 52. This type of quick fill connection is an improvement over the prior art which utilized an automobile-type air valve installed on the bottom cap. By providing a large flow area for filling the balloon 12, the present invention increases the flexibility of a lighting system in accordance with the present invention since the balloon 12 can be inflated and deflated much more rapidly than prior art devices. Alternatively, balloon 14 may be deflated extremely rapidly by opening the helium-tight zipper 63.

Bottom cap 26 is also a convenient location for mounting a pressure activated switch operable to respond to the pressure in the balloon 12. Pressure activated switch 56 is connected to the light source 16 and is operable to disconnect the light source 16 from its power source in response to the pressure in the balloon dropping below a predetermined value. This safety feature reduces the risk of damage to the balloon fabric in the event that the balloon deflates while the lights are energized. Prior art devices have utilized a mechanical switch connected to the support cables within the balloon to sense when the balloon is collapsing around the light source. Advantageously, pressure activated switch 56 can be set to deactivate the light source 16 upon a much smaller decrease in pressure than can be sensed by prior art mechanical switches. Pressure activated switch 56 may have a setpoint that deactivates light source 16 prior to any mechanical deformation of the balloon structure 12. When electrically connected to a dimmer 20, pressure activated switch 56 may be operable to dim light source 16 to any predetermined level upon the reduction of the pressure in the balloon to a predetermined value.

A hoop or disc 21 may be provided to connect the polar and equatorial support wires 32,36. The light source 16 is illustrated as being attached to wire 36 below hoop 21, although it may be supported alternatively from the hoop 21 or from one or more of the equatorial support wires 32. The light source 16 is releasably and rotatably connected to hoop 21 by swivel connector 37. Swivel connector 37 works advantageously with a cap 26 that is provided with a threaded connection. Threads 59 join cap 26 and cap mounting plate 53. Prior art balloon lighting devices have been provided with a cap having an O-ring connection. Threads 59 provide an improved gas seal. By providing a rotatable connection 37 between wire 36 and hoop 21, cap 26 may be installed without twisting of the electrical wire 48 with support wire 36.

An alternative embodiment of the present invention is illustrated in the FIGURE as balloon lighting device 15. Balloon lighting device 15 includes a balloon 14 having three sides 17 shaped in a generally triangular cross section and having opposed ends 19 interconnecting the opposed edges of the sides 17. The FIGURE illustrates balloon 14 in a partial cut-away view to illustrate a support mechanism for the light source 18 in accordance with this invention. Light source 18 is secured to the balloon by cables 57 which are attached to end caps (not shown) joined to each of the respective ends 19 of the balloon 14. A side cap 60 is joined to each side 17 of balloon 14, and is attached to the light source 18 by cables 62. A bottom cap 64 is formed on the bottom side of balloon 14 and is attached to light source 18 by cable 66. Similar to the light source support structure of balloon lighting device 11, the system of caps and cables of balloon lighting device 15 constitutes a means for resisting movement of the light source 18 in any direction away from a predetermined position. This support design provides three-dimensional support to resist the movement of the lighting device 18 relative to the balloon 14. Cap 64, cable 66, caps 60, and the vertical component of the support provided by cables 62 may be considered a polar attachment supporting the light source 18. Similarly the end caps (not shown), cables 57, and the horizontal component of the support provided by cables 62 constitute an equatorial attachment supporting light source 18. Bottom cap 64 may include the features previously described in regard to bottom cap 26 of balloon lighting device 11. Cable 66 may include a spring means, as may any of the other cables 57, 62 of the light source support structure. A safety shield 68 may be disposed in balloon 14 below light source 18 in order to protect the balloon in the event of the rupture of bulb 70 of light source 18. The safety shield 68 may be a screen or plate type device positioned to capture portions of lamp 70 that may fall toward the balloon surface after being broken.

The above described light source support structures provide an improved device for supporting a light source within a balloon lighting device. It is also important to provide adequate external support for the balloon in order to minimize the movement of the balloon in windy environments. Balloon lighting device 15 is illustrated as having a tether cable 72 attached to an exterior connector 74 connected to side cap 60. Similar tethers 72 may be attached to the other caps provided on balloon lighting devices 11 and 15. The plurality of equatorial caps provide a plurality of support locations for securing a tether line 72, thereby improving the stability of balloon 12, 14 in a windy environment.

Dimmer 20 also provides a convenient means for securing a balloon lighting device 11, 15. Dimmer 20 is secured to the balloon by cable 48 which is utilized to provide power to light source 16, 18. Depending upon the size of the balloon 12, 14, dimmer 20 may function as a ballast sufficient to secure balloon 12, 14 when it is filled with a lighter-than-air gas. As illustrated for balloon lighting device 11, dimmer 20 may be provided with a handle 76 for conveniently relocating the balloon 12 during use. Alternatively, if balloon 12, 14 has sufficient volume to support the weight of dimmer 20, as illustrated for balloon lighting device 15, the dimmer 20 may be supported by balloon 14 above the ground. This is an advantageous embodiment for applications such as movie sets within a studio where lay-down space is at a premium. In the embodiment of balloon lighting device 15, additional support for balloon 14 may be provided by tether cable 72 and/or by tether cable 78 attached to electrical cable 48 by an adjustable gripping device 80. Gripping device 80 may be an apparatus for fastening and adjusting a line as is described more fully in U.S. Pat. No. 5,327,845 issued to Cook on Jul. 12, 1994, incorporated by reference herein. The use of an adjustable gripping means 80 on cable 48 allows the altitude of the balloon to be adjusted simply and rapidly, thereby improving the flexibility of the lighting system. Advantageously, cable 48 is inserted through an opening formed in gripping device 80 so that gripping device 80 completely surrounds cable 48, making it impossible for cable 48 to be pulled away from gripping device 80. Once the cable 48 is inserted through the opening formed in gripping device 80, a spring-loaded gripper engages the cable 48 to hold it securely within the opening until it is released by an operator depressing a trigger or other release mechanism.

Light source 16, 18 is preferably connected to a dimmer 20 for controlling the intensity of the light produced by balloon lighting device 11, 15. Dimmer 20 may be any type of power regulating device operable to regulate the amount of light emitted from light source 16,18. The particular circuitry utilized in dimmer 20 will depend upon the type of light source 16,18 used. A dimmer 20 providing four channels of control at 4,000 watts/channel with a 220 VAC input for use with tungsten lights is available from Electrol Engineering Inc., Forest Hill, Md. Advantageously, dimmer 20 is provided with a Dimmer Multiplex protocol (DMX) control capability as is known in the art of lighting control systems. DMX capability allows a plurality of lights to be controlled by a single control cable 82. Such a control cable 82 may be a five wire, twenty-four gage control cable that is relatively light and easy to handle as compared to power cables 84 which are used to connect the dimmer 20 to an electrical power source (not shown). A plurality of lights may be controlled from a single lighting control panel 22. Furthermore dimmer 20 may be provided with a remote control capability such as infrared controller 86 to further simplify the control of balloon lighting devices 11, 15.

For many lighting applications it is desirable to control the color temperature of the light source. It is known in the lighting industry to utilize a gel filter in front of a light source to control the color temperature of the output of the light. For example, it is known to use a Correct To Blue (CTB) gel to correct tungsten light to daylight, or to use a Correct To Orange (CTO) gel to correct daylight to tungsten. Prior art balloon lighting devices have been incapable of use with a gel filter because the geometry of the balloon provides light in three dimensions, thereby making prior art filters ineffective. Dimmer 20 provides a means for controlling the color temperature of a balloon lighting device 11,15. By reducing the voltage supplied to an incandescent light source such as a tungsten light, the color temperature of the light can be varied. An alternative means for controlling the color temperature of a balloon lighting device 11,15 is shroud 44 that is discussed above. The shroud 44 may be sized to fit completely and/or tightly around balloon 12 and may be colored to achieve the desired gel effect. Dimmer 20 has limitations as a means for controlling color temperature since only certain types of lights, such as tungsten lamps, can be dimmed, and the light generated by the light source can be corrected in only one direction. Shroud 44 has more flexibility as a means for controlling color temperature since it is effective with any type of light source 16,18 and a large variety of gel affects can be achieved by proper selection of the color of the shroud 44.

It is known to provide light within a balloon by using an incandescent bulb, a light emitting diodes, or a fiber optic light source. Applications requiring only a small amount of light are known to utilize any of these light sources. Applications requiring a large amount of light energy, such as lighting for a move studio set, have previously required incandescent bulbs as the light source. Such devices are capable of providing only white light at a single wattage level. Balloon lighting device 15 provides the additional capability of a dimmer 20 for quickly varying the wattage of power supplied to bulb 70 and thereby the light emitted from the balloon 14. Balloon lighting device 11 illustrates an alternative embodiment of a light source 16 wherein an array 86 of high intensity light emitting diodes is utilized as a light source. Advantageously, the array 86 may include red, green and blue light emitting diodes, thereby enabling the lighting control system to provide a full spectrum of color combinations when the light from the individuals diodes of the array is combined. To more evenly supply light to the surface of the balloon 12, a plurality of arrays 86 of light emitting diodes are arranged to direct light toward a respective plurality of portions of the balloon 12. A means for diffusing light 88 such as a prism or lens may be disposed between the light emitting diodes and the surface of the balloon 12 to diffuse the light before it impinges upon the balloon surface. The array 86 of light emitting diodes may be combined with incandescent lamps, strobe lights, and/or fiber optic light sources within a single balloon to provide any desired combination of lighting effects. Light source 16 may include a support frame for a plurality of arrays 86 of light emitting diodes arranged in any shape such as, for example, an octagonal or hexagonal shape. One embodiment of an array 86 of light emitting diodes is commercially available from Borealis Corporation, Carrollton, Tex.

The FIGURE also illustrates a reflector 90 disposed within balloon lighting device 11. The reflector may be formed of a plurality of segments that fold to a size small enough to pass through the opening of the balloon bottom cap. Reflector 90 may be supported from the top cap 28 and/or equatorial caps 30. An opening 92 may be formed in the reflector 90 for passage of wire 36 therethrough.

The reflector 90 has a reflective side facing the light source 16 and functions to reflect light produced by light source 16, thereby increasing the amount of light energy emitted from the balloon 12 in a predetermined direction. For most applications, the reflector 90 may be positioned above the light source 16 in order to direct light downward.

The above embodiments are described by means of illustration not limitation. Accordingly the full scope of this invention is as claimed below.

I claim as my invention:

1. A balloon lighting device comprising:

a balloon;

a light source disposed inside the balloon at a predetermined position relative to the balloon; and a means for resisting movement of the light source in any direction away from the predetermined position;

wherein the means for resisting movement further comprises:

a polar attachment connecting the light source to opposed poles of the balloon; and an equatorial attachment connecting the light source to an equator of the balloon.

2. The device of claim 1, wherein the equatorial attachment comprises cable attachments between the balloon and the light source at three spaced apart locations along the equator.

3. The device of claim 1, wherein the equatorial attachment comprises cable attachments between the balloon and the light source at four spaced apart locations along the equator.

4. The device of claim 1, wherein the equatorial attachment comprises a plurality of caps joined to the balloon, each cap comprising an interior connector connected to the light source and an exterior connector.

5. The device of claim 4, further comprising a tether connected to at least one of the plurality of caps.

6. The device of claim 4, further comprising a shroud connected to at least one of the plurality of caps.

7. The device of claim 1, wherein the polar attachment comprises a top cap, the top cap further comprising an interior connector connected to the light source and an exterior connector.

8. The device of claim 7, further comprising a shroud connected to the exterior connector.

9. The device of claim 1, wherein the polar attachment comprises a wire connected between a top pole and the light source and a spring connection between a bottom pole and the light source.

10. The device of claim 1, further comprising a cap joined to the balloon, the cap comprising means for delivering power to the light source and a quick fill swirl connection for filling the balloon, and further comprising a seal for the quick fill swirl connection.

11. The device of claim 10, wherein the means for delivering power comprises a wire passing through the cap, and further comprising a stress relief device attached between the wire and the cap.

12. The device of claim 1, further comprising a pressure activated switch connected to the light source and operable to disconnect the light source from a power source in response to pressure in the balloon dropping below a predetermined value.

13. The device of claim 1, further comprising a dimmer connected to the light source.

14. The device of claim 13, wherein the dimmer further comprises a DMX control capability.

15. The device of claim 13, wherein the dimmer further comprises a remote control capability.

16. The device of claim 13, wherein the balloon is filled with a lighter-than-air gas, and further comprising the dimmer being attached to and supported above the ground by the balloon.

17. The device of claim 1, wherein the light source comprises an array of light emitting diodes.

18. The device of claim 17, further comprising a means for diffusing light produced by the array before the light impinges on the balloon.

19. The device of claim 1, wherein the light source comprises a plurality of arrays of light emitting diodes arranged to direct light toward a respective plurality of portions of the balloon.

20. The device of claim 19, further comprising a means for diffusing light produced by at least one of the plurality of arrays before said light impinges on the balloon.

21. The device of claim 17, wherein the array comprises at least one each of a red, a green, and a blue light emitting diode.

22. The device of claim 1, further comprising a shield disposed in the balloon below the light source.

23. The device of claim 1, wherein the balloon comprises polyurethane coated nylon joined along respective edge portions by a heat seal process.

24. The device of claim 1, further comprising:

a cable passing from an exterior of the balloon to the light source;

a gripping device surrounding the cable and releasably attached to the cable outside the balloon; and a tether attached to the gripping device.

25. A balloon lighting device comprising:

a balloon;

an array of light emitting diodes disposed within the balloon;

a cap joined to the balloon;

an electrical connection having a first end attached to the array, a length passing through the cap, and a second end extending away from the balloon;

a dimmer connected to the second end and operable to control light emitted from the arrays;

a top cap joined to the balloon opposed the bottom cap;

at least three side caps joined to the balloon and spaced along an equator of the balloon;

an attachment between the array and each of the top cap, bottom cap, and at least three side cans for supporting the array at a predetermined position relative to the balloon.

26. The device of claim 25, further comprising a means for diffusing light produced by the array before the light impinges on the balloon.

27. The device of claim 25, wherein the array further comprises a plurality of arrays of light emitting diodes arranged to direct light toward a respective plurality of portions of the balloon.

28. The device of claim 25, further comprising a means for diffusing light produced by at least one of the plurality of arrays before said light impinges on the balloon.

29. The device of claim 25, wherein the array comprises at least one each of a red, a green, and a blue light emitting diode.

30. The device of claim 25, wherein the dimmer comprises a DMX control capability.

31. The device of claim 25, wherein the dimmer comprises a remote control capability.

32. The device of claim 25, further comprising an incandescent light source disposed within the balloon.

33. The device of claim 25, wherein the balloon is filled with a lighter-than-air gas, and further comprising the dimmer being attached to the balloon.

34. The device of claim 33, wherein the dimmer comprises a DMX control capability, and further comprising a control panel located remote from the dimmer and balloon and connected to the dimmer by a control cable.

35. The device of claim 25, wherein each of the side caps comprises an external connector, and further comprising a restraining device attached to at least one of the external connectors.

36. The device of claim 25, wherein the top cap comprises an external connector, and further comprising a shroud connected to the exterior connector.

37. The device of claim 25, wherein the electrical connection comprises a cable, and further comprising:

a gripping device surrounding the cable and releasably attached to the cable outside the balloon; and a tether attached to the gripping device.

38. A balloon lighting device comprising:

a balloon having a plurality of cans joined thereto;

a light source disposed within the balloon and supported by at least one of the caps therein; and a shroud attached to an exterior of at least one of the caps and disposed over at least a portion of an outer surface of the balloon.

39. The balloon lighting device of claim 38, wherein the shroud comprises a color operable to affect the color temperature of light produced by the balloon lighting device.

40. The balloon lighting device of claim 38, further comprising:

a cap joined to the balloon;

a means for supporting the light source attached to an interior of the cap; and the shroud being attached to an exterior of the cap.

41. The balloon lighting device of claim 38, wherein the shroud comprises an opaque material.

42. The balloon lighting device of claim 41, wherein the shroud covers half of the outer surface of the balloon lighting device.

43. A balloon lighting device comprising:

a balloon;

a light source disposed within the balloon;

a reflector disposed within the balloon; a cap joined to the balloon, wherein the reflector is attached to the cap; a wire connecting the light to the cap, and further comprising an opening formed in the reflector for passage of the wire therethrough.

44. The balloon lighting device of claim 43, further comprising a plurality of caps joined to the balloon, and wherein the reflector is attached to the plurality of caps.

45. A balloon lighting device comprising;

a balloon;

a lamp disposed within the balloon;

a safety shield comprising a screen supported between the lamp and the balloon to protect the balloon from the lamp.

46. A balloon lighting device comprising;

a balloon;

a light source disposed within the balloon;

a cap joined to the balloon, the cap comprising a means for delivering power to the light source and a quick fill swirl connection for filling the balloon; wherein the quick fill swirl connection further comprises a threaded hole formed in the cap for the introduction of gas into the balloon and a seal screwed into the hole for sealing the gas in the balloon.

47. A balloon lighting device comprising;

a balloon;

a light source disposed within the balloon;

a cable passing from an exterior of the balloon to the light source;

a gripping device releasably attached to the cable outside the balloon; and a tether attached to the gripping device.

* * * * *